US010762815B2

(12) United States Patent
Tsai et al.

(10) Patent No.: US 10,762,815 B2
(45) Date of Patent: Sep. 1, 2020

(54) DISPLAY PANEL WITH AN OPENING

(71) Applicant: Au Optronics Corporation, Hsinchu (TW)

(72) Inventors: Yao-Jiun Tsai, Kaohsiung (TW); Ming-Hung Chuang, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 29 days.

(21) Appl. No.: 15/939,324

(22) Filed: Mar. 29, 2018

(65) Prior Publication Data

US 2019/0139474 A1 May 9, 2019

(30) Foreign Application Priority Data

Nov. 8, 2017 (TW) ..... 106138608 A

(51) Int. Cl.
*G09G 3/30* (2006.01)
*G09G 3/36* (2006.01)
*G09G 3/20* (2006.01)

(52) U.S. Cl.
CPC ..... *G09G 3/20* (2013.01); *G09G 2300/0426* (2013.01); *G09G 2310/0205* (2013.01); *G09G 2310/0232* (2013.01); *G09G 2310/0281* (2013.01); *G09G 2310/0286* (2013.01)

(58) Field of Classification Search
CPC ..... G09G 3/3266; G09G 3/3674–3681; G09G 2310/02–0221; G09G 2310/0267–0297; G09G 2310/062; G09G 2310/067
See application file for complete search history.

(56) References Cited

U.S. PATENT DOCUMENTS

2016/0111040 A1* 4/2016 Kim ..... G02F 1/13454 345/698
2016/0155400 A1* 6/2016 Namkung ..... G09G 3/3614 345/205
2016/0307642 A1 10/2016 Ochiai et al.
2017/0352328 A1 12/2017 Jeong et al.
2019/0363141 A1* 11/2019 Ueno ..... H01L 27/146

FOREIGN PATENT DOCUMENTS

CN 105609040 5/2016
TW 201801061 1/2018

* cited by examiner

*Primary Examiner* — Sanghyuk Park
(74) *Attorney, Agent, or Firm* — JCIPRNET

(57) ABSTRACT

A display panel includes a substrate, an opening, a first gate driving circuit, a second gate driving circuit, a plurality of first gate lines, a plurality of second gate lines, and a plurality of third gate lines. The substrate has a display area, a first peripheral region, and a second peripheral region. The opening is located in the display area. The first gate driving circuit is located in the first peripheral region. The second gate driving circuit is located in the second peripheral region. The first gate lines are located between the opening and the first gate driving circuit. The second gate lines are located between the opening and the second gate driving circuit. The third gate lines are located between the first gate driving circuit and the second gate driving circuit.

11 Claims, 6 Drawing Sheets

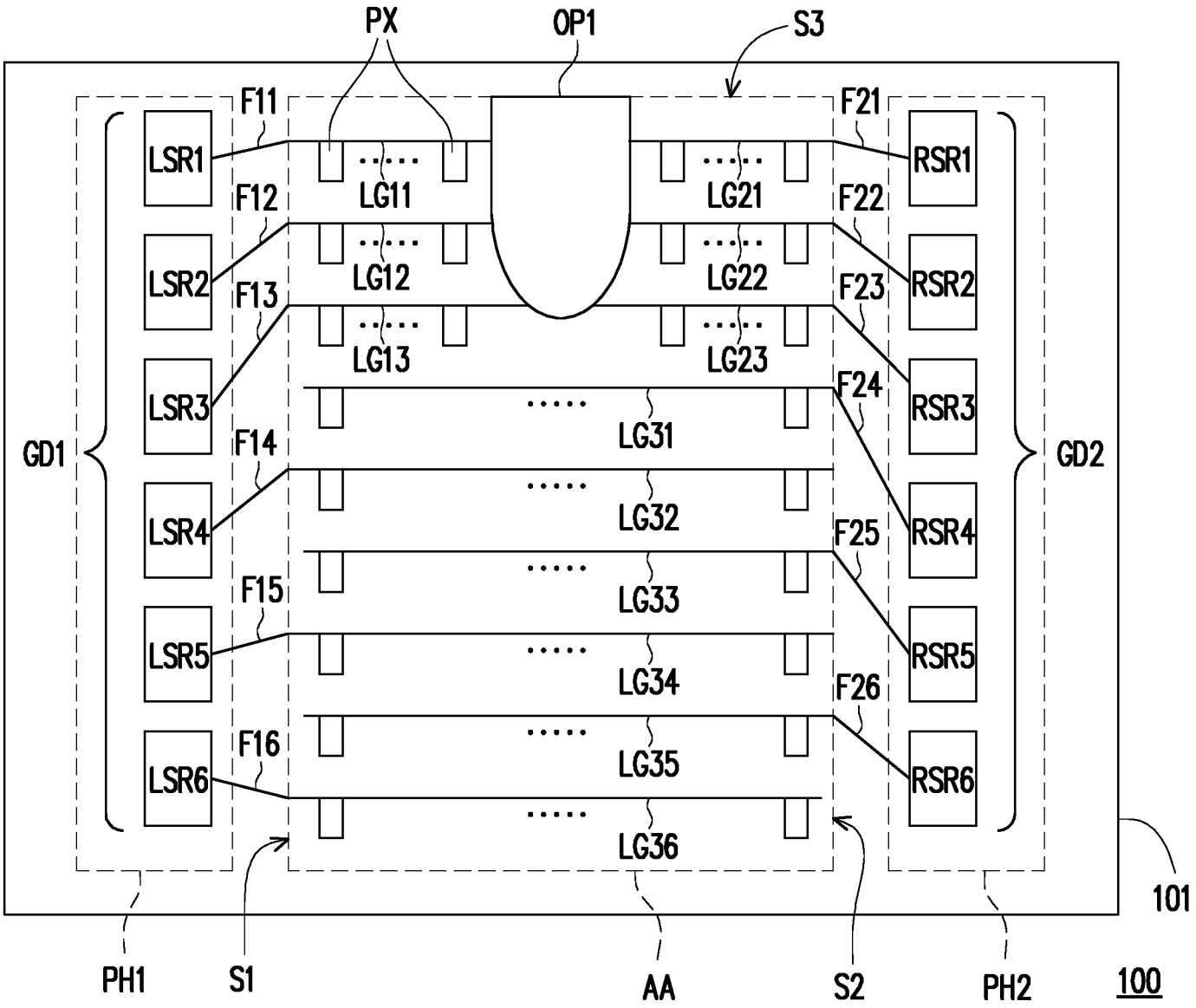
100 FIG. 1

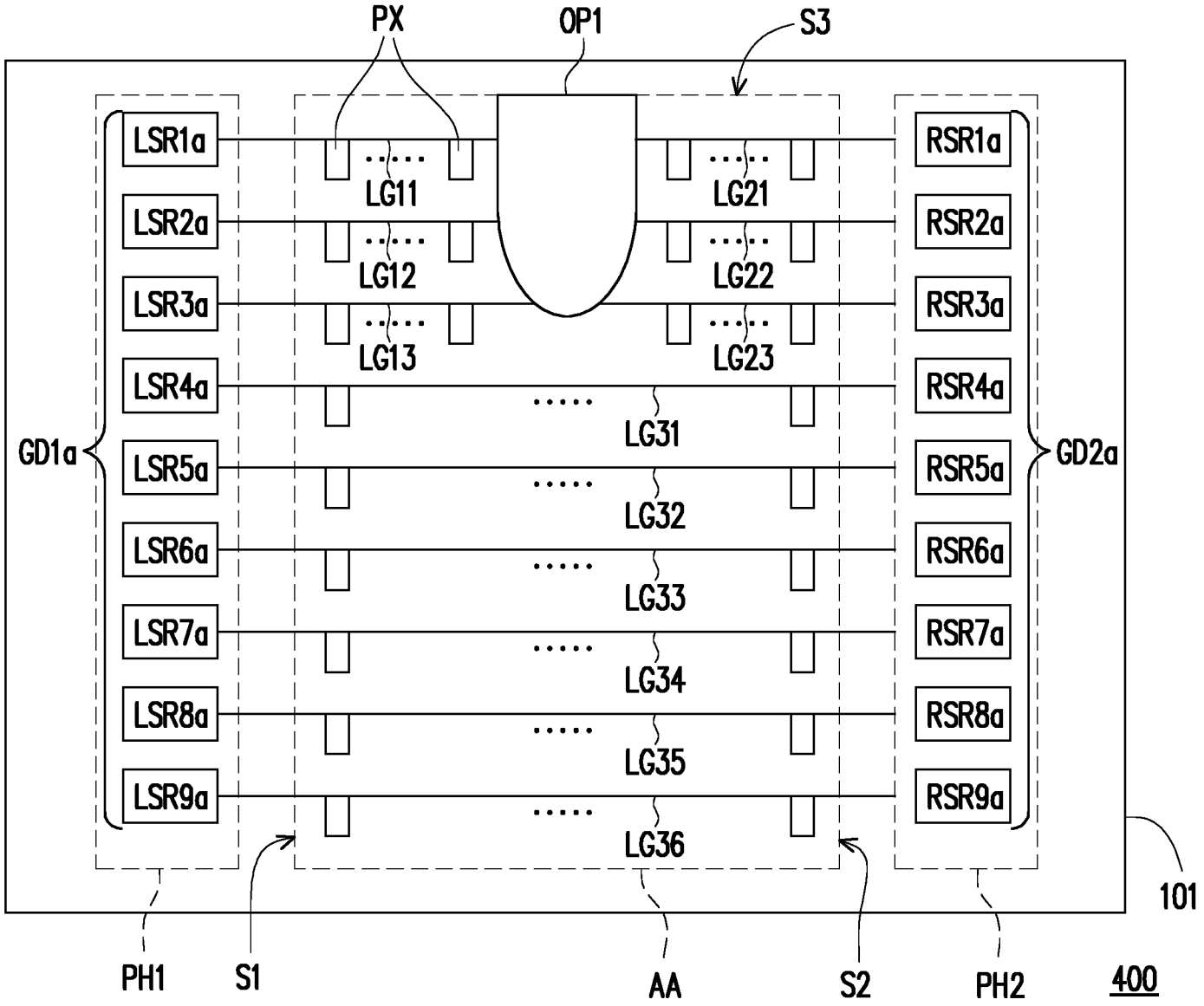
400 FIG. 5

DISPLAY PANEL WITH AN OPENING

CROSS-REFERENCE TO RELATED APPLICATION

This application claims the priority benefit of Taiwan application serial no. 106138608, filed on Nov. 8, 2017. The entirety of the above-mentioned patent application is hereby incorporated by reference herein and made a part of this specification.

BACKGROUND OF THE INVENTION

Field of Invention

The invention relates to a display panel; more particularly, the invention relates to a display panel having an opening.

Description of Related Art

At present, screens of smart phones are bigger and bigger, and on the premise of not increasing the volume of the smart phones, many manufacturers of the smart phones have adopted high resolution display panels with narrow border or ultra-narrow border, so as to increase the proportion of the display parts and further expand the display parts. Here, the display part accounts for at least 80% of the whole screen of the smart phone, which seems to have become the standard of the smart phones. However, the sound-optic components (e.g., lenses, speakers, and so forth) on the smart phones reduce the proportion accounted for by the rectangular display panels. As such, a display panel having an opening has been developed to increase the proportion accounted for by the display panel. However, no circuit may be disposed at the opening; hence, a new circuit layout should be developed for the display panel with the opening, so as to drive pixels on the display panel in a normal manner.

SUMMARY OF INVENTION

The invention provides a display panel which may ensure that pixels around an opening are not squeezed, so as not to lessen display effects of the pixels.

In an embodiment of the invention, a display panel includes a substrate, an opening, a first gate driving circuit, a second gate driving circuit, a plurality of first gate lines, a plurality of second gate lines, and a plurality of third gate lines. The substrate has a display area, a first peripheral region, and a second peripheral region, wherein the first peripheral region is located on a first side of the display area, and the second peripheral region is located on a second side of the display area opposite to the first side. The opening is located in the display area. The first gate driving circuit is located in the first peripheral region. The second gate driving circuit is located in the second peripheral region. The first gate lines are located between the opening and the first gate driving circuit, electrically connected to the first gate driving circuit, and electrically insulated from the second gate driving circuit. The second gate lines are located between the opening and the second gate driving circuit, electrically connected to the second gate driving circuit, and electrically insulated from the first gate driving circuit. The third gate lines are located between the first gate driving circuit and the second gate driving circuit, and each of the third gate lines is electrically connected to at least one of the first gate driving circuit and the second gate driving circuit.

In the display panel provided in an embodiment of the invention, the first gate lines and the second gate lines are electrically connected to the first gate driving circuit and the second gate driving circuit, respectively; therefore, no additional traces or conductive wires are required. That is, the pixels around the opening are not squeezed, and the display effects of the pixels are not lessened.

To make the foregoing features and advantages of the invention clearer and more comprehensible, embodiments are described below in detail with reference to the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

FIG. 1 is a schematic view illustrating a system of a display panel according to a first embodiment of the invention.

FIG. 5 is a schematic view illustrating a system of a display panel according to a first embodiment of the invention.

DESCRIPTIONS OF THE EMBODIMENTS

Figure 2A:
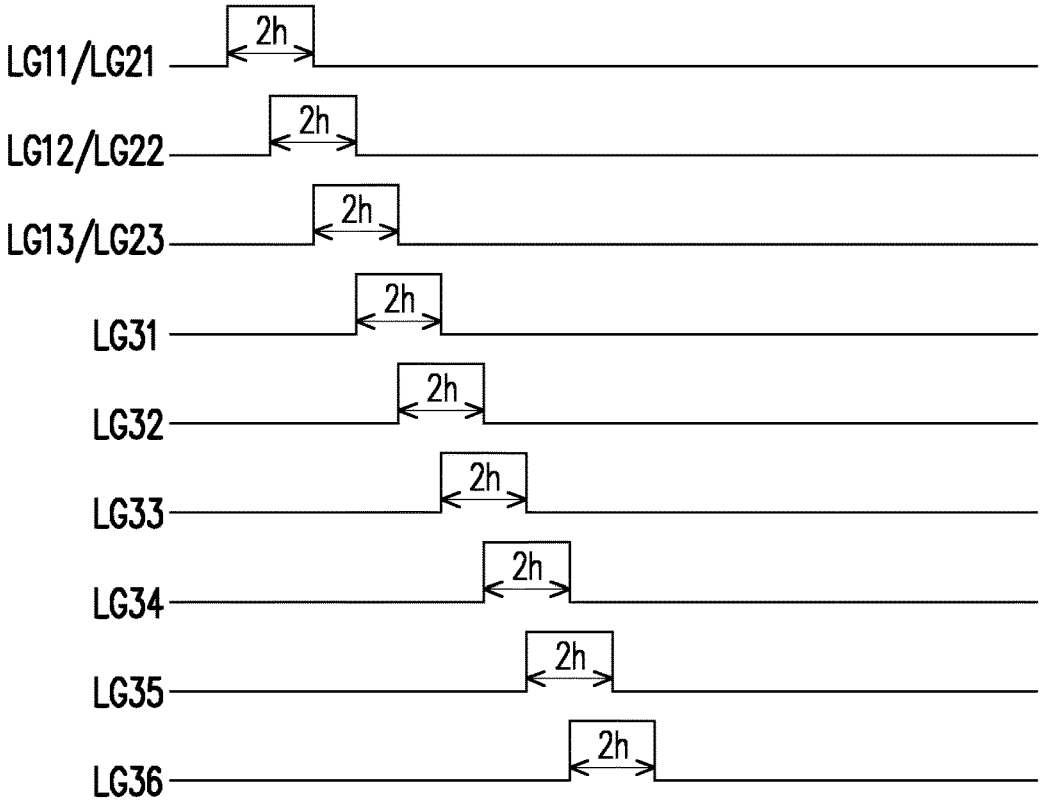
FIG. 2A to FIG. 2D schematically illustrate driving waveforms of the display panel according to the first embodiment of the invention.

FIG. 1 is a schematic view illustrating a system of a display panel according to a first embodiment of the invention. With reference to FIG. 1, in the present embodiment, the display panel 100 includes a substrate 101, an opening OP1, a first gate driving circuit GD1, a second gate driving circuit GD2, a plurality of first gate lines (e.g., LG11-LG13), a plurality of second gate lines (e.g., LG21-LG23), a plurality of third gate lines (e.g., LG31-LG36), and a plurality of fan-out lines (e.g., F11-F16, F21-F26). The number of components provided herein is merely exemplary, while the invention is not limited thereto.

The substrate 101 has a display area AA, a first peripheral region PH1, and a second peripheral region PH2. The first peripheral region PH1 is located on a first side S1 of the display area AA (e.g., the left side in FIG. 1), the second peripheral region PH1 is located on a second side S2 of the display area AA (e.g., the right side in FIG. 1), and the second side S2 is opposite to the first side S1. There are a plurality of pixels PX in the display area AA. In some embodiments, the first peripheral region PH1 and the second peripheral region PH2 may be on a side of the substrate 101 or on the back of the substrate 101.

The first gate driving circuit GD1 is located in the first peripheral region PH1 and has a plurality of shift registers arranged in the first peripheral region PH1. Here, six shift registers LSR1-LSR6 are taken as an example. The second gate driving circuits GD2 is located in the second peripheral region PH2 and has a plurality of shift registers arranged in the second peripheral region PH2. Here, six shift registers RSR1-RSR6 are taken as an example. The opening OP1 is located in the display area AA, wherein the opening OP1 is aligned with a third side S3 of the display area AA different from the first side S1 and the second side S2, and the opening OP1 is located in the middle of the third side S3. Here, the upper side in FIG. 1 is taken as an example of the third side S3.

The first gate lines (e.g., LG11-LG03) are located in the display area AA and between the opening OP1 and the first gate driving circuit GD1; namely, the horizontal position of the first gate lines (e.g., LG11-LG13) is the same as the horizontal position of the opening OP1. The first gate lines (e.g., LG11-LG13) are electrically connected to the first gate driving circuit GD1 and electrically insulated from the second gate driving circuit GD2. That is, the first gate lines (e.g., LG11-LG13) are electrically connected to the corresponding shift registers LSR1-LSR3, respectively, but the first gate lines (e.g., LG11-LG13) are not electrically connected to the shift registers RSR1-RSR6.

The second gate lines (e.g., LG21-LG23) are located in the display area AA and between the opening OP1 and the second gate driving circuit GD2; namely, the horizontal position of the second gate lines (e.g., LG21-LG23) is the same as the horizontal position of the opening OP1. The second gate lines (e.g., LG21-LG23) are electrically connected to the second gate driving circuit GD2 but electrically insulated from the first gate driving circuit GD1. That is, the second gate lines (e.g., LG21-LG23) are only electrically connected to the corresponding shift registers RSR1-RSR3 respectively and not electrically connected to the shift registers LSR1-LSR6.

The third gate lines (e.g., LG31-LG36) are located in the display area AA and between the first gate driving circuit GD1 and the second gate driving circuit GD2; namely, the horizontal position of the third gate lines (e.g., LG31-LG36) is different from the horizontal position of the opening OP1. Each of the third gate lines (e.g., LG31-LG36) are electrically connected to one of the first gate driving circuit GD1 and the second gate driving circuit GD2 in an alternate manner. For instance, some of the third gate lines LG32, LG34, LG36 . . . are electrically connected to the shift registers LSR4-LSR6, and some of the third lines LG31, LG33, LG35 . . . are electrically connected to the shift registers RSR4-RSR6. The rest connection relationship may be deduced from the above with reference to the drawings. Namely, the third gate lines (e.g., LG32, LG34, LG36 . . . ) electrically connected to the shift registers LSR4-LSR6 of the first gate driving circuit GD1 are not adjacent, and the third gate lines (e.g., LG31, LG33, LG35 . . . ) electrically connected to the shift registers RSR4-RLSR6 of the second gate driving circuit GD2 are not adjacent.

In addition, in the present embodiment, the number of shift registers (e.g., LSR1-LSR6) of the first gate driving circuit GD1 is the same as the number of shift registers (e.g., RSR1-RSR6) of the second gate driving circuit GD2 but less than the number of rows of pixels PX. Hence, the shift registers LSR1-LSR6 and the shift registers RSR1-RSR6 may extend in a vertical direction. That is, the shift registers LSR1-LSR6 may evenly share the first peripheral region PH1, and the shift registers RSR1-RSR6 may evenly share the second peripheral region PH2. Thereby, the widths of the shift registers LSR1-LSR6 and the shift registers RSR1-RSR6 (e.g., the lengths in a horizontal direction) may be reduced, so as to reduce the width of borders of the display panel 100.

On the other hand, the number of shift registers (e.g., LSR1-LSR6) of the first gate driving circuit GD1 is the same as the number of shift registers (e.g., RSR1-RSR6) of the second gate driving circuit GD2 and is less than the number of rows of pixels PX. Since the shift registers LSR1-LSR6 and the shift registers RSR1-RSR6 are unable to be aligned with the corresponding first gate lines (e.g., LG11-LG13), the corresponding second gate lines (e.g., LG21-LG23), or the corresponding third gate lines (e.g., LG31-LG36), the first gate lines (e.g., LG11-LG13) and the third gate lines (e.g., LG32, LG34, and LG36) are electrically connected to the corresponding shift registers LSR1-LSR6 through the fan-out lines F11-F16, respectively, and the second gate lines (e.g., LG21-LG23) and the third gate lines (e.g., LG31, LG33, and LG35) are electrically connected to the corresponding shift registers through the fan-out lines F21-F26, respectively.

In the present embodiment, it is illustrated that the first gate lines (e.g., LG11-LG13) are each aligned with the corresponding second gate lines (e.g., LG21-LG23); however, in consideration of different circuit designs, the first gate lines (e.g., LG11-LG13) are not required to be aligned with the second gate lines (e.g., LG21-LG23), which may be determined according to the structure of the display panel 100 and should not be limited to the present embodiment.

According to the present embodiment, the first peripheral region PH1, the second peripheral region PH2, and the display area AA are located on the same surface of the substrate 101; however, in other embodiments of the invention, the first peripheral region PH1 and the second peripheral region PH2 may be located on a side of the substrate 101 or on the back of the substrate 101 (e.g., on other surfaces relative to the surface of the display area AA).

In light of the foregoing, the first gate lines (e.g., LG11-LG13) and the second gate lines (e.g., LG21-LG23) are driven by the first gate driving circuit GD1 and the second gate driving circuit GD2, respectively; therefore, no additional traces or conductive wires are required. That is, the pixels PX around the opening OP1 are not squeezed, and the display effects of the pixels PX are not lessened.

FIG. 2A to FIG. 2D schematically illustrate driving waveforms of the display panel according to the first embodiment of the invention. With reference to FIG. 1 and FIG. 2A, in the present embodiment, the first gate lines (e.g., LG11-LG13) are sequentially enabled, the second gate lines (e.g., LG21-LG23) are sequentially enabled, and the third gate lines (e.g., LG31-LG36) are sequentially enabled. The first gate lines (e.g., LG11-LG13) and the second gate lines (e.g., LG21-LG23) are simultaneously enabled, and the third gate lines (e.g., LG31-LG36) are enabled after the first gate lines (e.g., LG11-LG13) are enabled. Here, enabled times of the first gate lines (e.g., LG11-LG13), enabled times of the second gate lines (e.g., LG21-LG23), and enabled times of the third gate lines (e.g., LG31-LG36) are all set as two horizontal scanning time (labeled as 2 h).

Figure 2B:
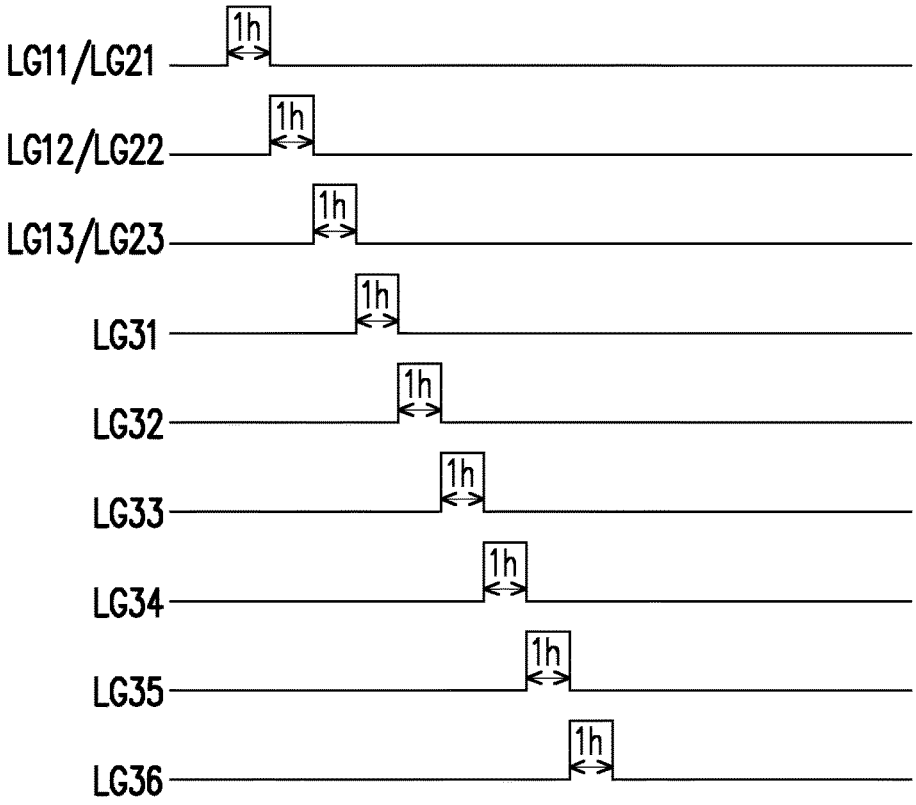

With reference to FIG. 1 and FIG. 2B, in the present embodiment, the first gate lines (e.g., LG11-LG13) are sequentially enabled, the second gate lines (e.g., LG21-LG23) are sequentially enabled, and the third gate lines (e.g., LG31-LG36) are sequentially enabled. The first gate lines (e.g., LG11-LG13) and the second gate lines (e.g., LG21-LG23) are simultaneously enabled, and the third gate lines (e.g., LG31-LG36) are enabled after the first gate lines (e.g., LG11-LG13) are enabled. Here, the enabled times of the first gate lines (e.g., LG11-LG13), the enabled times of the second gate lines (e.g., LG21-LG23), and the enabled times of the third gate lines (e.g., LG31-LG36) are all set as one horizontal scanning time (labeled as 1 h).

Figure 2C:
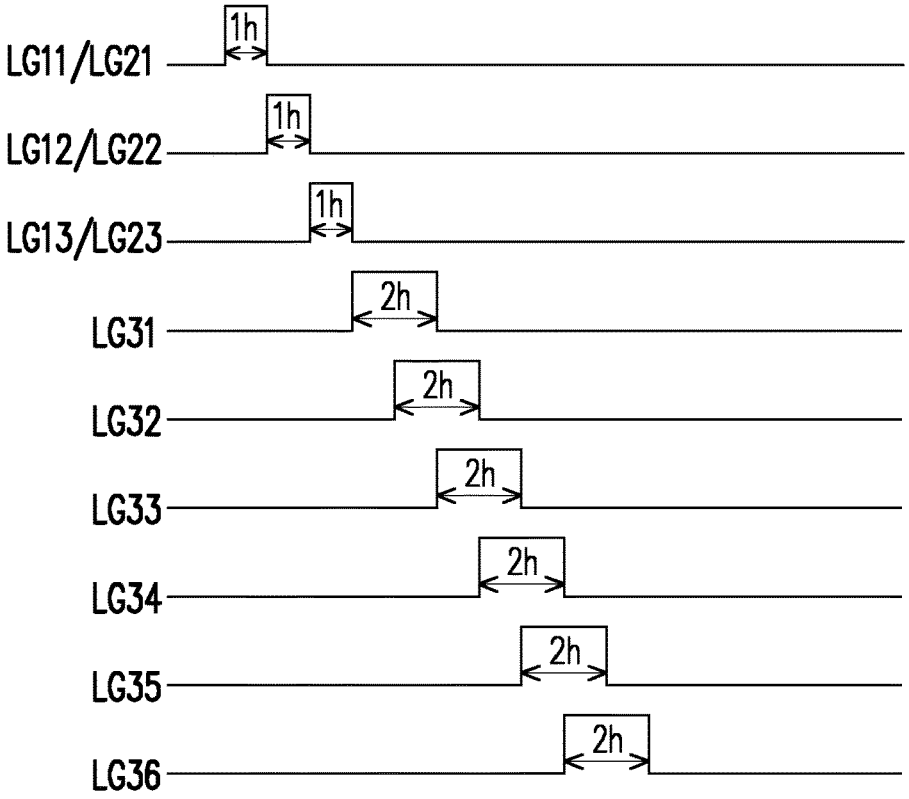

With reference to FIG. 1 and FIG. 2C, in the present embodiment, the first gate lines (e.g., LG11-LG13) are sequentially enabled, the second gate lines (e.g., LG21-LG23) are sequentially enabled, and the third gate lines (e.g., LG31-LG36) are sequentially enabled. The first gate lines (e.g., LG11-LG13) and the second gate lines (e.g., LG21-LG23) are simultaneously enabled, and the third gate lines (e.g., LG31-LG36) are enabled after the first gate lines (e.g., LG11-LG13) are enabled. Here, the enabled times of the first gate lines (e.g., LG11-LG13) and the enabled times of the second gate lines (e.g., LG21-LG23) are identically set as one horizontal scanning time (labeled as 1 h), while the enabled times of the third gate lines (e.g., LG31-LG36) are set as two horizontal scanning time (labeled as 2 h) and are different from the enabled times of second gate lines (e.g., LG21-LG23).

Figure 2D:
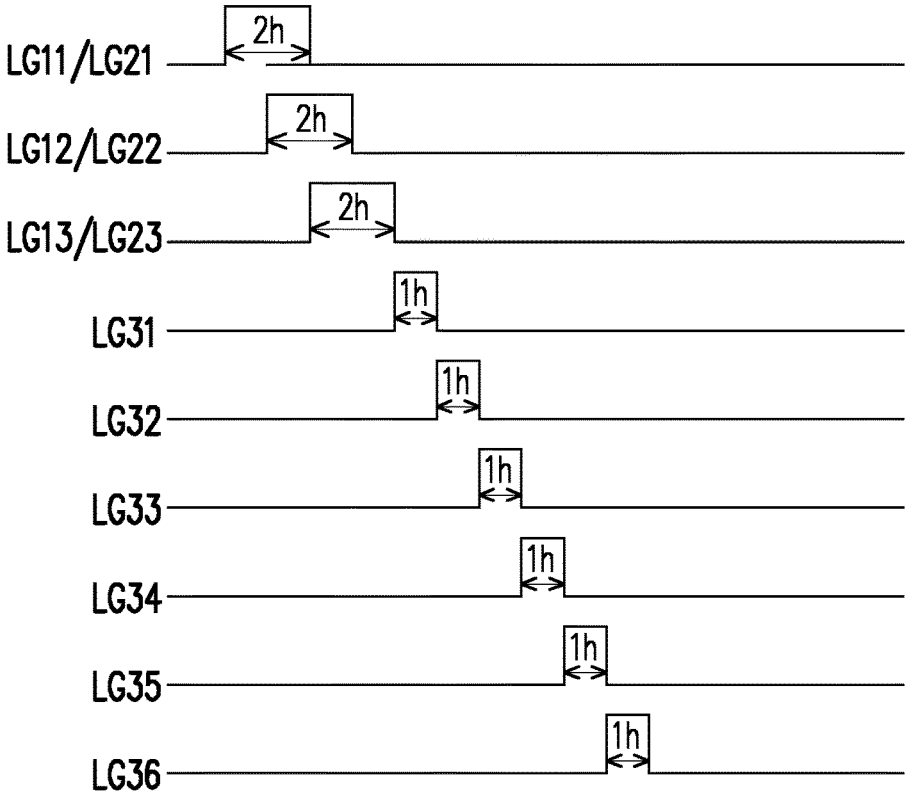

With reference to FIG. 1 and FIG. 2D, in the present embodiment, the first gate lines (e.g., LG11-LG13) are sequentially enabled, the second gate lines (e.g., LG21-LG23) are sequentially enabled, and the third gate lines (e.g., LG31-LG36) are sequentially enabled. The first gate lines (e.g., LG11-LG13) and the second gate lines (e.g., LG21-LG23) are simultaneously enabled, and the third gate lines (e.g., LG31-LG36) are enabled after the first gate lines (e.g., LG11-LG13) are enabled. Here, the enabled times of the first gate lines (e.g., LG11-LG13) and the enabled times of the second gate lines (e.g., LG21-LG23) are identically set as two horizontal scanning time (labeled as 2 h), while the enabled times of the third gate lines (e.g., LG31-LG36) are set as one horizontal scanning time (labeled as 1 h) and are different from the enabled times of the second gate lines (e.g., LG21-LG23).

Figure 3:
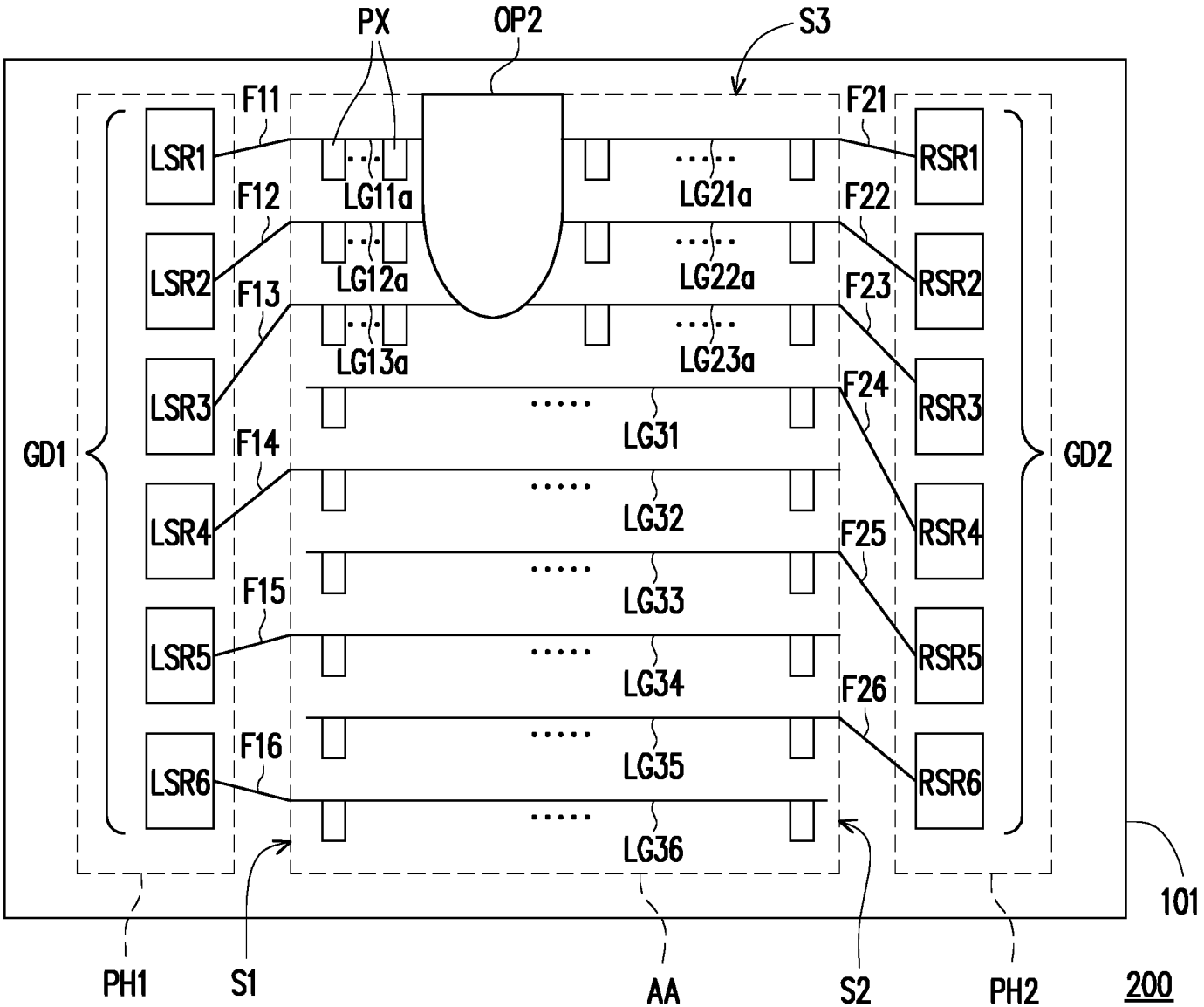
FIG. 3 is a schematic view illustrating a system of a display panel according to a first embodiment of the invention.

FIG. 3 is a schematic view illustrating a system of a display panel according to a first embodiment of the invention. With reference to FIG. 1 and FIG. 3, in this embodiment, the display panel 200 is substantially the same as the display panel 100 except for the position of the opening OP2. In this embodiment, the opening OP2 is still aligned with the third side S3 of the display area AA but located closer to the first side S1, so that the first gate lines (e.g., LG11*a*-LG13*a*) appear to be shorter, while the second gate lines (e.g., LG21*a*-LG23*a*) appears to be longer.

Figure 4:
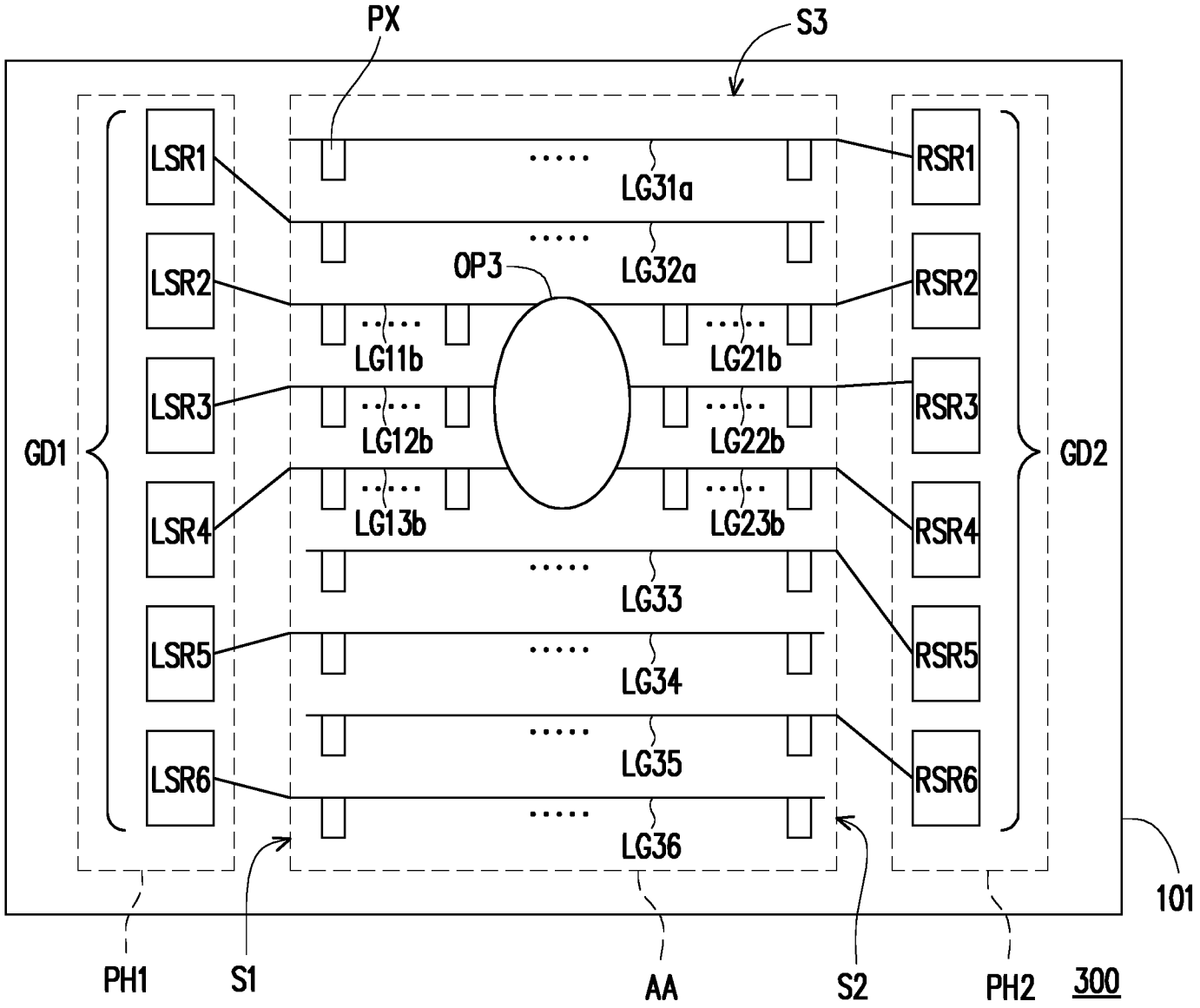
FIG. 4 is a schematic view illustrating a system of a display panel according to a first embodiment of the invention.

FIG. 4 is a schematic view illustrating a system of a display panel according to a first embodiment of the invention. With reference to FIG. 1 and FIG. 4, in this embodiment, the display panel 300 is substantially the same as the display panel 100 except for the position of the opening OP3. In this embodiment, the opening OP3 is away from the sides (such as S1 and S2) of the display area AA; that is, the opening OP3 is not aligned with any side (such as S1 or S2) of the display area AA. Therefore, the third gate lines LG31*a* and LG32*a* are located above the opening OP3. That is, the first gate lines (e.g., LG11*b*-LG13*b*) and the second gate lines (e.g., LG21*b*-LG23*b*) are located between the third gate lines LG32*a* and LG33.

FIG. 5 is a schematic view illustrating a system of a display panel according to a first embodiment of the invention. With reference to FIG. 1 and FIG. 5, in this embodiment, the display panel 400 is substantially the same as the display panel 100 except for the number of the shift registers LSR1*a*-LSR9*a* and the number of the shift registers RSR1*a*-RSR9*a* (e.g., nine shift registers in this embodiment). In this embodiment, the first gate lines (e.g., LG11-LG13) are electrically connected to the corresponding shift registers LSR1*a*-LSR3*a*, respectively, the second gate lines (e.g., LG21-LG23) are electrically connected to the corresponding shift registers RSR1*a*-RSR3*a*, and each of the third gate lines (e.g., LG31-LG36) is electrically connected to the first gate driving circuit GD1*a* and the second gate driving circuit GD2*a* at the same time, i.e., each of the third gate lines (e.g., LG31 to LG36) is electrically connected to the corresponding shift registers (e.g., LSR4*a* to LSR9*a*) in the first gate driving circuit GD1*a* and the corresponding shift registers (e.g., RSR4*a* to RSR9*a*) in the second gate driving circuit GD2*a*.

In the present embodiment, the number of shift registers (e.g., LSR1*a*-LSR9*a*) of the first gate driving circuit GD1*a* is the same as the number of shift registers (e.g., RSR1*a*-RSR9*a*) of the second gate driving circuit GD2*a* and is the same as the number of rows of the pixels PX; therefore, the shift registers LSR1*a*-LSR9*a* are individually aligned with the corresponding first gate lines (e.g., LG11-LG13) or the corresponding third gate lines (e.g., LG31-LG36), and the shift register RSR1*a*-RSR9*a* are individually aligned with the corresponding second gate lines (e.g., LG21-LG23) or the corresponding third gate lines (e.g., LG31-LG36). Therefore, the first gate lines (e.g., LG11-LG13) and the third gate lines (e.g., LG31-LG36) do not need to be electrically connected to the corresponding shift registers LSR1*a*-LSR9*a* through fan-out lines, and the second gate lines (e.g., LG21-LG23) and the third gate lines (e.g., LG31-LG36) do not need to be electrically connected to the corresponding shift registers RSR1*a*-RSR9*a* through fan-out lines.

In view of the above, the display panel provided in the embodiment of the invention at least includes the substrate 101, the opening (e.g., OP1, OP2, or OP3), the first gate driving circuit (e.g., GD1 or GD1*a*), the second gate driving circuit (e.g., GD2 or GD2*a*), a plurality of first gate lines (e.g., LG11-LG13, LG11*a*-LG13*a*, or LG11*b*-LG13*b*), a plurality of second gate lines (e.g., LG21-LG23, LG21*a*-LG23*a*, or LG21*b*-LG23*b*), and a plurality of third gate lines (e.g., LG31-LG36, LG31*a*, or LG32*a*). The substrate has a display area AA, a first peripheral region PH1, and a second peripheral region PH2. The opening (e.g., OP1, OP2, or OP3) is located in the display area AA. The first gate driving circuit (e.g., GD1 or GD1*a*) is located in the first peripheral region PH1. The second gate driving circuit (e.g., GD2 or GD2*a*) is located in the second peripheral region PH2. The first gate lines (e.g., LG11-LG13, LG11*a*-LG13*a*, or LG11*b*-LG13*b*) are located between the opening (e.g., OP1, OP2, or OP3) and the first gate driving circuit (e.g., GD1 or GD1*a*), electrically connected to the first gate driving circuit (e.g., GD1 or GD1*a*), and electrically insulated from the second gate driving circuit (e.g., GD2 or GD2*a*). The second gate lines (e.g., LG21-LG23, LG21*a*-LG23*a*, or LG21*b*-LG23*b*) are located between the opening (e.g., OP1, OP2, or OP3) and the second gate driving circuit (e.g., GD2 or GD2*a*), electrically connected to the second gate driving circuit (e.g., GD2 or GD2*a*), and electrically insulated from the first gate driving circuit (e.g., GD1 or GD1*a*). The third gate lines (e.g., LG31-LG36, LG31*a*, or LG32*a*) are located between the first gate driving circuit (e.g., GD1 or GD1*a*) and the second gate driving circuit (e.g., GD2 or GD2*a*), and each of the third gate lines (e.g., LG31-LG36, LG31*a*, or LG32*a*) is electrically connected to at least one of the first gate driving circuit (e.g., GD1 or GD1*a*) and the second gate driving circuit (e.g., GD2 or GD2*a*).

To sum up, in the display panel provided in an embodiment of the invention, the first gate lines and the second gate lines are electrically connected to the first gate driving circuit and the second gate driving circuit, respectively; therefore, no additional traces or conductive wires are required. That is, the pixels around the opening are not squeezed, and the display effects of the pixels are not lessened.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display panel, comprising:

a substrate having a display area, a first peripheral region, and a second peripheral region, wherein the first peripheral region is located on a first side of the display area, and the second peripheral region is located on a second side of the display area opposite to the first side;

an opening located in the display area;

a first gate driving circuit located in the first peripheral region;

a second gate driving circuit located in the second peripheral region;

a plurality of first gate lines located between the opening and the first gate driving circuit, electrically connected to the first gate driving circuit, electrically insulated from the second gate driving circuit, and are not overlapped with the opening;

a plurality of second gate lines located between the opening and the second gate driving circuit, electrically connected to the second gate driving circuit, electrically insulated from the first gate driving circuit, and are not overlapped with the opening; and a plurality of third gate lines located between the first gate driving circuit and the second gate driving circuit, each of the third gate lines being electrically connected to at least one of the first gate driving circuit and the second gate driving circuit, wherein each of the first gate lines is aligned with one of the second gate lines along a extend direction of the each of the first gate lines from the first gate driving circuit to the opening or a extend direction of the one of the second gate lines from the second gate driving circuit to the opening, and the first gate lines extend directly to the opening and the second gate lines extend directly to the opening.

2. The display panel as recited in claim 1, wherein the first gate lines are sequentially enabled, the second gate lines are sequentially enabled, the third gate lines are sequentially enabled, the first gate lines and the second gate lines are simultaneously enabled, and the third gate lines are enabled after the first gate lines are enabled, wherein a plurality of enabled times of the first gate lines, a plurality of enabled times of the second gate lines and a plurality of enabled times of the third gate lines are the same.

3. The display panel as recited in claim 1, wherein the first gate lines are sequentially enabled, the second gate lines are sequentially enabled, the third gate lines are sequentially enabled, the first gate lines and the second gate lines are simultaneously enabled, and the third gate lines are enabled after the first gate lines are enabled, wherein a plurality of enabled times of the first gate lines and a plurality of enabled times of the second gate lines are the same, and the enabled times of the second gate lines and a plurality of enabled times of the third gate lines are different from each other.

4. The display panel as recited in claim 1, wherein each of the third gate lines is electrically connected to the first gate driving circuit and the second gate driving circuit.

5. The display panel as recited in claim 1, wherein the third gate lines electrically connected to the first gate driving circuit are not adjacent to each other.

6. The display panel as recited in claim 1, wherein a plurality of shift registers of the first gate driving circuit are disposed in the first peripheral region, and a plurality of shift registers of the second gate driving circuit are disposed in the second peripheral region.

7. The display panel as recited in claim 1, wherein each of the third gate lines is electrically connected to the first gate driving circuit and the second gate driving circuit at the same time, a plurality of shift registers of the first gate driving circuit are individually aligned with one of the first gate lines or one of the third gate lines, and a plurality of shift registers of the second gate driving circuit are individually aligned with one of the second gate lines or one of the third gate lines.

8. The display panel as recited in claim 1, wherein the opening is aligned with a third side of the display area different from the first side and the second side.

9. The display panel as recited in claim 1, wherein the opening is away from the first side or the second side of the display area.

10. The display panel as recited in claim 1, wherein each of the first gate lines is adjacent to one another, and each of the second gate lines is adjacent to one another.

11. The display panel as recited in claim 1, wherein all of the first gate lines extend directly to the opening in only one direction, and all of the second gate lines extend directly to the opening in only one direction.

* * * * *